United States Patent [19]

Bowles

[11] 4,319,109

[45] Mar. 9, 1982

[54] CENTERED UTENSIL SENSOR FOR INDUCTION SURFACE UNITS

[75] Inventor: Howard R. Bowles, Louisville, Ky.

[73] Assignee: General Electric Company, Louisville, Ky.

[21] Appl. No.: 108,087

[22] Filed: Dec. 28, 1979

[51] Int. Cl.[3] ..... H05B 6/12

[52] U.S. Cl. ..... 219/10.49 R; 219/10.77; 219/10.67; 219/518; 340/686; 324/260; 99/DIG. 14

[58] Field of Search ..... 29/10.77, 10.75, 10.67, 29/10.79, 10.43, 10.49 R, 518, 450; 340/686, 687; 99/451, DIG. 14; 324/260, 261, 219, 220

[56] References Cited

U.S. PATENT DOCUMENTS

| | | | |
|---|---|---|---|
| 2,155,425 | 4/1939 | La Mere | 219/518 X |
| 3,223,414 | 12/1965 | Uecker | 340/686 X |
| 3,463,491 | 8/1969 | Shaw | 340/686 X |
| 3,530,499 | 9/1970 | Schroeder | 219/10.49 R |
| 3,796,850 | 3/1974 | Moreland et al. | 219/10.49 R |
| 3,823,297 | 7/1974 | Cunningham | 219/10.77 |
| 3,843,857 | 10/1974 | Cunningham | 219/10.49 R |
| 3,993,885 | 11/1976 | Kominami et al. | 219/10.75 X |
| 4,010,342 | 3/1977 | Austin | 219/10.49 R |
| 4,013,859 | 3/1977 | Peters, Jr. | 219/10.77 X |
| 4,016,392 | 4/1977 | Kobayashi et al. | 219/10.49 R |

*Primary Examiner*—Gene Z. Rubinson
*Assistant Examiner*—Philip H. Leung
*Attorney, Agent, or Firm*—Bernard J. Lacomis; Radford M. Reams

[57] ABSTRACT

A sensor arrangement for an induction heating apparatus which monitors the position of a cooking utensil on a work surface and disables an inverter circuit powering a work coil if the utensil is located at an off-center position with respect to the coil, or if no utensil is present upon the cooking surface. The sensor arrangement comprises a plurality of sets of sensors at successively larger distances from the center of the work surface. Each set comprises a plurality of sensors arranged on an imaginary circle substantially equidistant from each other. Each sensor operates to provide an indication of the presence or absence of a utensil directly above the sensor. The sensors are monitored by a logic arrangement which indicates whether a utensil is properly centered, based on the fullness or degree of activation of the various sets. If the utensil is not properly positioned, the inverter is disabled and a signal advises the user of this condition. Additionally, the logic circuit determines the size of a properly positioned utensil and generates a signal which may be utilized to alter the output of the work coil in accordance therewith.

9 Claims, 4 Drawing Figures

| TRUTH TABLE | | | | | | |
|---|---|---|---|---|---|---|
| 4" | 6" | 8" | CENTERED 4" PAN | CENTERED 6" PAN | CENTERED 8" PAN | OUTPUT OF NORGATE 54 |
| 0 0 0 | × × × | × × × | 0 | 0 | 0 | / |
| 0 0 / | ↓ | ↓ | 0 | 0 | 0 | / |
| ⋮ | | | ⋮ | ⋮ | ⋮ | ⋮ |
| / / / | | | / | 0 | 0 | 0 |
| / / / | 0 0 / | 0 0 0 | 0 | 0 | 0 | / |
| ↓ | ⋮ | ↓ | ⋮ | ⋮ | ⋮ | ⋮ |
| | / / / | | 0 | / | 0 | 0 |
| / / / | / / / | 0 0 / | 0 | 0 | 0 | / |
| ↓ | ↓ | ⋮ | ⋮ | ⋮ | ⋮ | ⋮ |
| | | / / / | 0 | 0 | / | 0 |

CENTERED UTENSIL SENSOR FOR INDUCTION SURFACE UNITS

CROSS REFERENCES TO RELATED APPLICATIONS

This application is related to an application Ser. No. 108,086 filed 12/28/79 in the name of Brent Beatty and entitled "Improved Sensing Arrangement for a Centered Utensil Detector" which is assigned to the same assignee as the instant application.

FIELD OF THE INVENTION

The present invention relates generally to induction heating or cooking apparatus, and, in particular, to a utensil position and presence detection arrangement used in an induction heating or cooking apparatus.

BACKGROUND OF THE INVENTION

The art of inductively coupling an induction heating coil with a ferrous utensil, thereby electromagnetically heating the contents of the utensil, has been widely known for many years. Additionally, many such prior art arrangements have included sensing arrangements for determining whether the utensil is placed on the cooking surface above the heating coil before the coil is powered. These sensing arrangements reduce the likelihood that high strength electromagnetic fields generated by the heating coil will be leaked into the space surrounding the cooking surface during periods when a proper load is not located on the cooking surface.

Various sensors have been used for this purpose. For example, U.S. Pat. No. 3,796,850-Moreland II et al utilizes a reed switch coupled to two magnets. If no utensil is placed over the induction heating unit, the contacts of the reed switch are forced to close due to the magnetic flux lines produced by the magnets. However, if a utensil is placed over the induction heating unit, the magnetic flux lines are not sufficiently strong to close the leaf contacts of the reed switch and the induction unit becomes operational.

Similarly, U.S. Pat. No. 3,993,885-Kominami et al includes a movable magnet, a fixed magnet and a reed switch situated between the two magnets. If a ferrous pan is placed upon the induction heating unit, the movable magnet is attracted towards the pan and the flux lines near the reed switch are changed so as to allow power to be supplied to the heating coil.

U.S. Pat. No. 4,013,859-Peters, Jr. utilizes a very low power oscillator coupled to a load sensing coil for indicating the presence of a pan above the work coil. Furthermore, U.S. Pat. Nos. 3,823,297-Cunningham; 4,016,392-Kobayashi et al; and 4,010,342-Austin include current or voltage detectors which also indicate the presence of a pan above the induction heating coil.

It has also been observed that the electromagnetic fields may be even further reduced by insuring that the ferromagnetic cooking utensil, in addition to being present above the work coil, is properly centered with respect to the induction coil. The strength of electromagnetic fields in the vicinity of the cooking surface, it has been observed, are dramatically increased merely by displacing the cooking utensil off-center with respect to the work coil.

However, while the above noted patents include detectors or sensors which would disable the inverter circuit of the induction work coil if no utensil was placed upon the cooking surfaces, none of these patents is directed to the problem of disabling the inverter circuit if a utensil is placed off-center upon the cooking surface with respect to the induction work coil.

SUMMARY OF THE INVENTION

The main objective of the present invention is to assure that a cooking utensil is properly positioned on an induction surface unit. In its most basic form the sensor assembly comprises a set of sensors arranged on an imaginary circle of a preselected radius, the distance between the sensors, along the circumference of the circle, being approximately equal so as to divide the imaginary circle into a plurality of substantially equal radial sectors. The exact number of sensors in the set and the spacing and relationship of the sensors to others in the set may be varied depending in part on the accuracy desired, but, preferably, the set contains at least three sensors.

Each sensor in the set is adapted to indicate the presence or absence of a portion of a utensil directly above it. In this manner and assuming a utensil having a radius of three inches, three sensors spaced 120° apart on a circle having a radius somewhat less than three inches would each be activated with the utensil centered directly thereover. Thus, a centered condition would be indicated by a full or completely activated set of sensors. On the other hand, a partly full set (less than all sensors activated) would indicate an off-center utensil, and an empty set (no sensor activated) would indicate the absence of the utensil entirely.

Thus, the invention relies on a monitoring of the degree of fullness of activation of a set of sensors to indicate an off-center position, centered position, or absence of a cooking utensil.

While a single set of sensors, as described above, is sufficient to detect the off-center condition of a utensil of known radius, a sensor arrangement more widely usable in conjunction with a variety of differently sized utensils requires a plurality of sensor sets, each arranged on an imaginary circle of progressively larger radius to correspond with utensils of different size. Using this sort of arrangement, the fullness of activation of the sensor sets may be interrogated to detect the presence, absence and off-center position of utensils.

To effectuate the multi-set arrangement above, a sensor assembly is located below the cooking surface and above the induction cooking coil of the inverter. The sensor assembly is comprised of a three-pronged star with each of the prongs located 120° apart and containing a like number of individual sensor elements for detecting the presence and position of a ferrous utensil with respect to the work coil. The sensors are grouped into sets, each set having its sensors located a common distance from the center of the cooking unit. The sensors of each set lie along the circumference of an imaginary circle, each set having a circle of different diameter associated therewith to cover typical sizes of cooking utensils. The sets, therefore, define a plurality of concentric circles, each circle having its center coincident with the center of the cooking unit.

A logic circuit operatively connected to the sensor assembly processes the signals produced by the sensor elements for determining whether the cooking utensil is properly centered upon the cooking surface.

The logic circuit generally operates to examine the fullness of activation of the sensor sets. If all the sensors in the innermost set are activated, the presence of a utensil is indicated. If the above condition exists and, in addition, each of the more distant sets having at least one sensor activated are fully activated, the utensil centered condition exists. A sensor set which is less than fully activated indicates an off-centered utensil.

Additionally, since the three-pronged sensor is designed to activate the heating unit when a symmetrical utensil such as circular, elliptical, oval, square, rectangular or the like, pan or skillet is properly placed upon the induction heating unit, the inverter would also be disabled if improper utensils such as knives, spoons, forks, etc. are placed upon the cooking surface. Furthermore, the sensor can sense the presence of a particular size of utensil and can adjust the inverter control accordingly.

BRIEF DESCRIPTION OF THE DRAWINGS

Further details of the present invention and many additional advantages of this invention will be apparent from a detailed consideration of the remainder of this specification and the accompanying drawings in which.

DETAILED DESCRIPTION OF THE DRAWINGS

Figure 1:
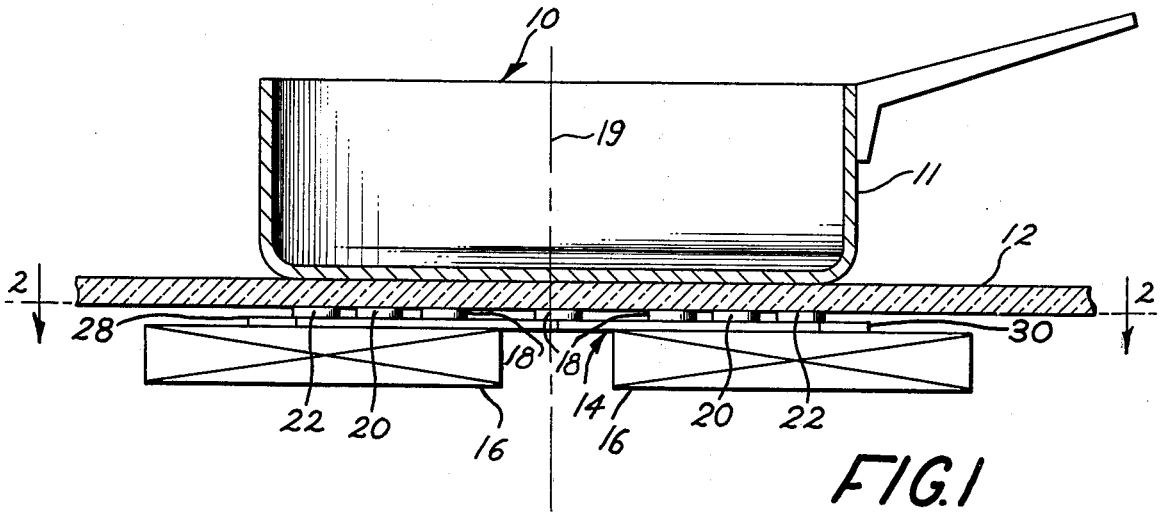
FIG. 1 is an illustrative vertical cross section showing the relationship between the cooking utensil on the cooking surfaces, the work coil and the sensing assembly.

Referring to FIG. 1, a utensil 10 containing a ferromagnetic surface 11 is shown properly placed upon a cooking surface 12. This surface is preferably constructed of a ceramic material such as glass which is waterproof, preferably electrically non-conductive and non-ferromagnetic in character. An induction cooking or work coil 16 is provided beneath the cooking surface 12 and is mounted such that its imaginary central axis 19 if extended upwardly through the cooking surface 12 passes through the approximate center of the cooking area on which utensil 10 is adapted to be located, the relative locations of the utensil 10 and the coil 16 being shown by dotted lines in FIG. 2. This coil may include a wire which is wound in a spiral and then held in place with an appropriate compound while maintaining the proper spacing between successive convolutions. A sensor assembly 14 is provided between the cooking surface 12 and the work coil 16.

Figure 2:
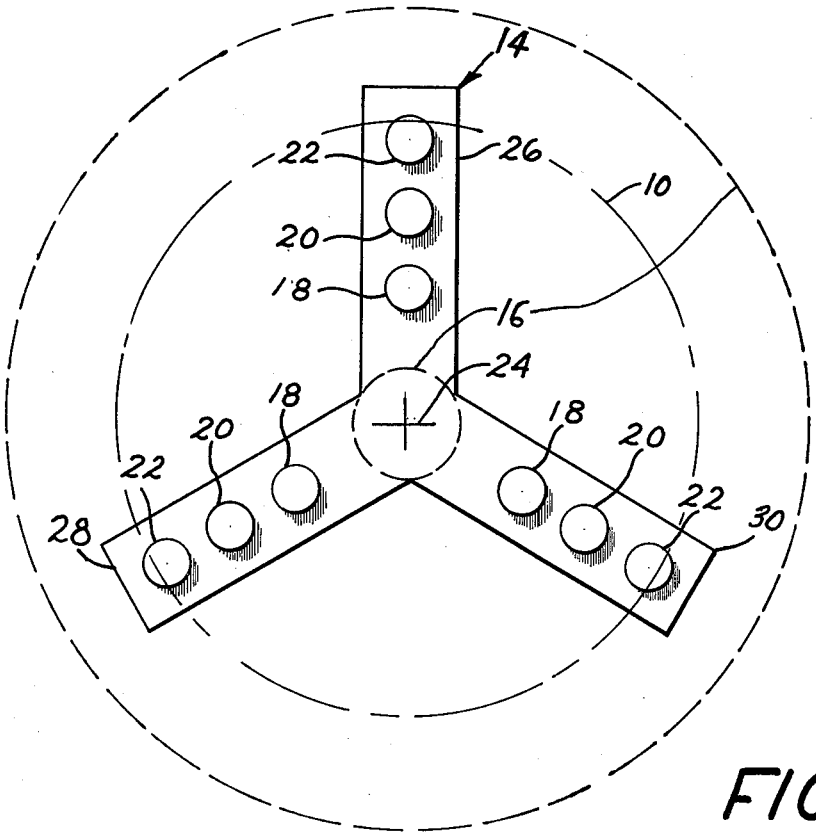
FIG. 2 is a plan view of the sensing assembly.

While the sensor assembly 14 may take a variety of forms within the teachings of the invention, a typical example is shown in FIG. 2. The sensor assembly 14 consists of a three-pronged star having individual prongs 26, 28 and 30 with each prong separated from the other prongs by approximately 120 degrees about its center 24. Each of the prongs contains a like number of individual sensor elements 18, 20 and 22 which detect the presence and the position of the ferromagnetic utensil 10. The sensors are organized into a plurality of sets, each set arranged at a different distance from the center of the cooking unit. Thus, referring to FIG. 2, the sensors 18 form a first set x, the sensors 20 for a second set y, and the sensors 22 form a third set z. Each of the sensors making up any one set is provided on the circumference of a circle concentric with the center of the cooking unit. Each set is associated with a circle of progressively larger diameter, and each sensor produces a signal if a portion of the utensil 10 is placed directly over each element. For the purpose of explanation, elements 18 (set x) are provided on the circumference of a circle having a diameter of four inches, elements 20 (set y) are provided on the circumference of a circle having a diameter of six inches and elements 22 (set z) are provided on a circle having a diameter of eight inches. The number of sensors provided on each of the prongs and their distance from the center may vary in accordance with the size of the utensils to be used and it should be understood that a lesser or greater number of sensors than is shown in FIG. 2 may be provided. For the purpose of this description, however, each prong contains three sensing elements.

Several types of sensing elements, such as weight sensors, Hall effect sensors or magnetic sensors can be utilized. The main criterion for utilizing a particular type of sensing element would be its ability to sense the presence of a utensil directly above it.

For example, if magnetic sensing elements such as reed switches are employed, each of the switches would be sensitive to the flux lines created from the interaction of the ferromagnetic utensil 10 and the work coil 16. The presence of the utensil above each sensor would shunt a substantial portion of the magnetic field allowing the sensor to indicate that the utensil is situated over it. Normally, in the presence of a strong magnetic field, the two leaves of the switch would be in contact. However, if the strength of the field is lessened, such as a result of the interaction of the work coil 16 and the ferromagnetic utensil placed above the sensor, the induced magnetism would be insufficient to maintain the switch in a closed position. The opening and closing of these switches may be monitored, as described hereinafter, to enable the detection of a utensil which is positioned off-center with respect to the sensor unit and the work coil 10.

Figures 3, 4:
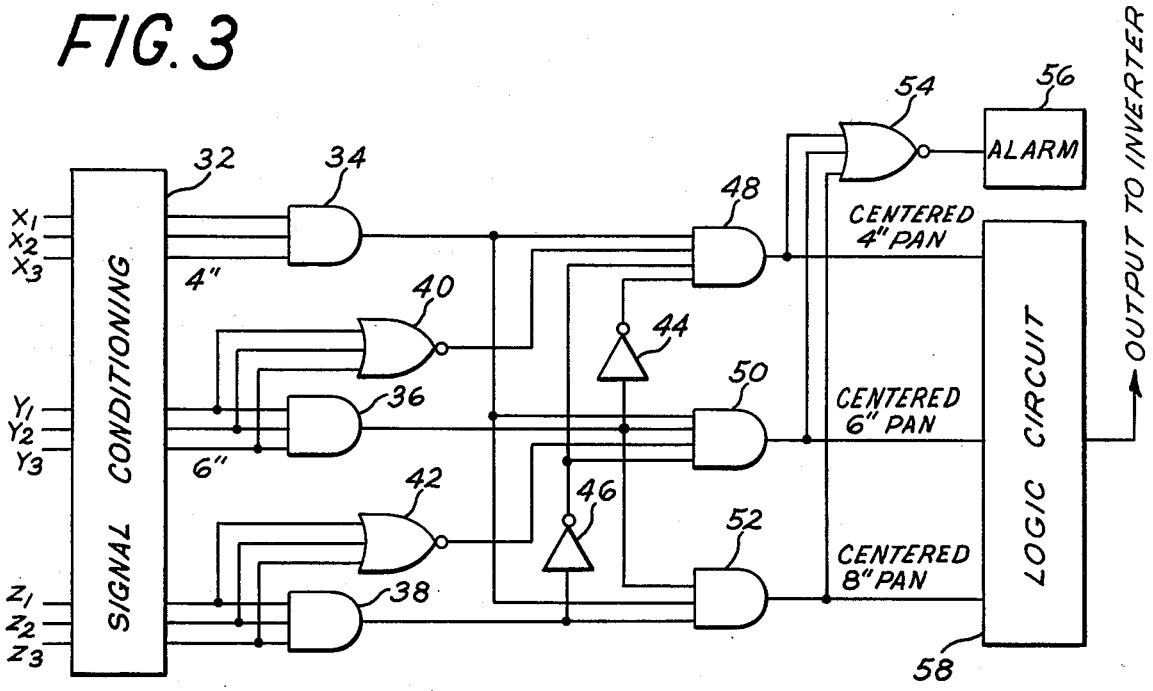
FIG. 3 shows a typical logic circuit used in conjunction with the sensing assembly.
FIG. 4 is the truth table used in conjunction with the circuit shown in FIG. 3.

FIG. 3 illustrates a typical logic circuit which might be utilized with the sensing elements shown in FIG. 2, the truth table corresponding to this logic circuit being shown in FIG. 4.

As indicated above, each of the sensors 18, 20 and 22 is constructed to produce a signal only when a portion of a ferromagnetic utensil is placed directly above it. If no utensil is placed above the sensor, no output is produced. Any signals produced by the sensors are transmitted to a signal conditioning circuit 32 for conditioning the signals so that they might be presented to a plurality of logic gates. For example, if Hall effect sensors are used, the signal conditioning circuit would transform or step up a relatively low level DC signal to a higher level sufficient to operate a logic gate. The circuit 32 may also be required to transform an AC voltage to a DC voltage prior to application to the logic gates. Conditioning circuits of this type are well known to those skilled in the art and a detailed description of such circuits is not deemed necessary to the understanding of this invention.

The logic circuit shown in FIG. 3 includes three AND gates 34, 36 and 38. The AND gates receive the outputs of the four inch sensor elements ($x_1$, $x_2$, $x_3$) the six inch sensor elements ($y_1$, $y_2$, $y_3$) and the eight inch sensor elements ($z_1$, $z_2$, $z_3$) respectively. Additionally, outputs $y_1$, $y_2$, $y_3$, $z_1$, $z_2$ and $z_3$ are also directly transmitted to NOR gates 40 and 42. Inverters 44 and 46 as well as AND gates 48, 50 and 52 are provided between AND gates 34, 36 and 38, NOR gates 40 and 42 and a final NOR gate 54. The output of AND gate 34 is provided to AND gates 48, 50 and 52. The output of AND gate 36 is provided to AND gates 50 and 52 and also serves as the input to inverter 44. The output of AND gate 38 is provided to AND gate 52 and also serves as the input to inverter 46. The output of NOR gate 40 as well as the output of inverters 44 and 46 serve as the final three inputs of AND gate 48. The output of NOR gate 42 as well as the output of inverter 46 serves as the final two inputs of AND gate 50. The output of AND gates 48, 50 and 52 serve as the three inputs to NOR gate 54. As shown in the truth table of FIG. 4 and the logic diagram of FIG. 3, the inverter is disabled if all of the inputs to NOR gate 54 are low (0) therefore producing a high output (1) at NOR gate 54. In other situations, the output is not disabled.

For example, if the outputs of sensors $x_1$, $x_2$ and $x_3$ are high and the output of sensors $y_1$, $y_2$, $y_3$, $z_1$, $z_2$ and $z_3$ are all low (indicating a centered 4" pan) the outputs of AND gate 34 as well as NOR gates 40 and 42 are high and the outputs of both AND gate 36 and AND gate 38 are low. Additionally, the output of inverters 44 and 46 are both high. Therefore, since all of the inputs to AND gate 48 are high and at least one input of either AND gate 50 or AND gate 52 is low, the output of NOR gate 54 is low and the inverter is not disabled.

However, for example, if the output of sensors $x_1$, $x_2$, $x_3$, $y_1$, $y_2$, $y_3$, $z_1$ and $z_2$ are all high and the output of sensor $z_3$ is low, the pan is not centered and the inverter should be disabled. In this situation, the output of AND gate 34 and AND gate 36 is high and the output of AND gate 38 is low. Since the outputs of NOR gate 40 and NOR gate 42 as well as AND gate 38 are low, the outputs of AND gate 48, AND gate 50 and AND gate 52 are also all low, forcing the output of NOR gate 54 to be high, and thereby disabling the inverter circuit. Similarly, analysis of FIG. 3 for all possible combinations of sensor outputs would indicate that if the utensil is properly centered, the inverter is not disabled; but, if the utensil is not properly centered, the inverter is disabled.

Thus, the logic circuit operates generally to monitor the fullness of activation of the sensor sets and make a logical decision as to the position of a cooking utensil based on the degree of fullness of the various activated sets of sensors.

The circuit shown in FIG. 3 can also be employed to control the output of the inverter dependent upon the size of a properly positioned utensil. If a four inch utensil is properly centered, the output of AND gate 48 is high and the outputs of AND gate 50 and AND gate 52 is low. If a six inch utensil is properly centered, the outputs of AND gate 48 and AND gate 50 are high and the output of AND gate 52 is low. Likewise, if an eight inch pan is properly centered, the outputs of AND gate 48, AND gate 50 and AND gate 52 would be high. The output of these AND gates is sent to a logic circuit 58 connected to the inverter. This logic circuit 58 adjusts the output of the inverter depending upon the size of a properly placed ferromagnetic material placed upon the cooking surface 12. Therefore, the sensor shown in FIG. 2 and the logic circuit shown in FIG. 3 not only determine whether a ferromagnetic utensil is properly positioned upon the cooking surface, but also the particular size of the utensil.

A visual or audio alarm 56, such as a bell, buzzer or light, may be connected to the output of NOR gate 54. This alarm would only be enabled if the output of the NOR gate is high, thereby disabling the inverter. The alarm would notify the user that the utensil is improperly positioned so that appropriate action can be taken.

Additionally, the off-center detector can be used to disable the inverter if a properly placed utensil were to be removed from the cooking surface.

The foregoing description shows only the preferred embodiments of the present invention. Various modifications are apparent to those skilled in the art without departing from the scope of the invention. Therefore, the embodiments shown and described are only illustrative and not restrictive.

What is claimed is:

1. In an induction cooking apparatus of the type including an induction heating coil and a cooking surface adapted for supporting a cooking utensil in a cooking area above said coil, the improvement comprising:

a utensil position detecting arrangement for generating a signal indicative of the position of said utensil relative to the approximate center of said area, said arrangement including a set of sensors located below said cooking surface, said set including a plurality of sensors located substantially the same distance from said center, each sensor operative to provide a signal indicative of the presence or absence of a portion of said utensil directly thereover, and signal processing means responsive to signals generated by said sensors for generating different output signals in response to the fullness of activation of said set.

2. The combination recited in claim 1 wherein said signal processing means includes logic circuit means for determining the size of the utensil placed upon the cooking surface.

3. The combination recited in claim 1 wherein said sensors are located between the cooking surface and the induction work coil.

4. The combination recited in claim 3 wherein said sensors comprise magnetic sensing elements.

5. The combination recited in claim 3 wherein said sensors comprise Hall effect sensing elements.

6. The combination recited in claim 1 further including circuit means for disabling said induction coil if the utensil is not properly positioned on the cooking surface, said disabling means responsive to said signal processing means.

7. The combination recited in claim 6 further including alarm means connected to said circuit means for disabling said induction coil for indicating that said induction coil has been disabled.

8. The combination recited in claim 1 wherein said detecting arrangement comprises a plurality of sets of sensors, the sensors of each set arranged at different distances from the center of said cooking apparatus corresponding to different utensil sizes.

9. The combination recited in claim 8 wherein said sensors in each set are substantially equidistant from each other on an imaginary circle having said common distance as the radius thereof.

* * * * *